US005125864A

United States Patent [19]

Roberson et al.

[11] Patent Number: 5,125,864

[45] Date of Patent: Jun. 30, 1992

[54] DOLL WITH HARNESS

[76] Inventors: Linda K. Roberson, P.O. Box 1518, Candler, N.C. 28715; Suzanne Mackey, 3 S. Pine Island Rd., Apartment 209B, Plantation, Fla. 33324; Cathy Mackey, P.O. Box 1518, Candler, N.C. 28715

[21] Appl. No.: 677,110

[22] Filed: Mar. 29, 1991

[51] Int. Cl.[5] ..... A63H 3/00

[52] U.S. Cl. ..... 446/268; 2/246

[58] Field of Search ..... 446/268, 369; 128/846, 128/869, 874, 876, 875; 119/96; 2/246; 182/3

[56] References Cited

U.S. PATENT DOCUMENTS

| | | | |
|---|---|---|---|
| 1,651,561 | 12/1927 | Storey | 128/875 X |
| 2,212,746 | 8/1940 | Nunn | 119/96 |
| 2,252,357 | 8/1941 | Shaw | 119/96 |
| 2,429,283 | 10/1947 | Veyt | 119/96 |
| 2,449,741 | 9/1948 | Fitzpatrick | 128/875 X |
| 4,478,311 | 10/1984 | Anderson | 119/96 X |
| 4,795,397 | 1/1989 | Stevens | 446/369 X |
| 4,875,237 | 10/1989 | Cohen | 2/246 X |
| 4,891,846 | 1/1990 | Sager et al. | 128/874 X |

OTHER PUBLICATIONS

"Car seat doll" Playthings, Mar. 1986, vol. 84, No. 3, p. 111.

*Primary Examiner*—Mickey Yu
*Attorney, Agent, or Firm*—William F. Hamrock

[57] ABSTRACT

The invention relates to a doll with a vest harness having a tether belt which can be self-contained on the harness or self-contained around a person's wrist such as a child's wrist. The harness further includes, on the vest, an emblem containing a code for identification of a child player.

13 Claims, 5 Drawing Sheets

DOLL WITH HARNESS

BACKGROUND OF THE INVENTION

1. Field of the Invention

This invention relates to a doll having a harness attached thereto, and in particular, to a doll having a harness which harness resembles the Child's Safety Harness of U.S. patent application Ser. No. 07/627,193, filed Dec. 13, 1990.

2. Description of Prior Art

There are serious problems that exist concerning proper identification of the large number of lost and missing children when they are found. These problems are discussed in copending application Ser. No. 07/627,193, filed Dec. 13, 1990, entitled Child's Safety Harness, applicants Linda K. Roberson and Suzanne Mackey who are also applicants of the present invention. and said, application hereafter will be referred to as Child's Safety Harness. That application is directed to solving many of these problems by having the child wear a Child's Safety Harness through which proper identification of the child can be made. That application is incorporated herein by reference since the present doll harness resembles the Child's Safety Harness and the present application is directed to solving many of these same problems.

As will be better understood from the detailed description of the present invention set forth below, a feasible doll construction which would assist in helping the child to recognize the many safety features attributed to wearing the child's safety harness would conceivably be of considerable value and assistance to the public in the area of child safety. To our knowledge, no doll construction has ever been created which incorporates the unique features as set forth herein after in our invention.

A doll construction for identification of a child has been proposed in U.S. Pat. No. 4,715,842 in which a doll construction is disclosed wherein fingerprints are provided for each doll and a record for recording fingerprint data and other information. However, such a doll construction and identification technique does not suggest any way our unique doll harness doll and identification procedure.

SUMMARY OF THE INVENTION

Many of the problems for the safety of small children are overcome by the Child's Safety Harness, code and procedure for positive identification of the child disclosed in that copending application. Among the steps proposed therein in accomplishing this are the following:

Each child is registered for membership in Child's Safety Club having its own logo. The child is given his or her own identification code. The logo and code are imprinted on an emblem secured to the safety harness to be worn by the child. A combination coloring booklet depicting the visual use of the harness as a safety device and why it should be worn is presented to the child. A Newsletter is published by the Club having the child's code and the codes of other children who are members of the club.

The above features are intended to raise the child's esteem by being a member of a Safety Club with other children which has its own logo and having his or her own identification code. The safety education is taught by use of the coloring booklet as a means of learning and as an enjoyable experience. The Newsletter is an added feature to increase the child's interest in safety in conjunction with other children.

The Child's Safety Harness is a unified integral garment worn on the upper torso of the child. It has a front vest section and criss-crossing back straps. Secured to the front of the vest is the emblem depicting the logo on its exposed front side and the child's identification code hidden on its back side. A waist belt extends around the lower section of the harness and is secured at the back thereof by a locking mechanism. A tether belt is an integral extension of the free end of the waist belt and can be either self-contained on the garment or looped around a guardian's wrist.

In accordance with the present invention, we provide a harness for a doll which harness attempts to resemble closely the Child's Safety Harness. The present doll's harness can be an individual harness that can be put on the doll or can be an integral part of the construction of the doll.

Our doll's harness attempts to repeat many of the features of the Child's Safety Harness in a simplified manner. The doll's harness includes a vest harness covering the upper torso of the doll. On the front vest portion is an emblem having the logo "Body Safety Kids Club". The back of the emblem on the interior side of the vest can be inscribed an identification code as on the Child's Safety Harness. Also included are joined and/or criss-crossing back straps, a waist belt and a tether belt similar to the configuration of the Child's Safety Harness.

To our knowledge no doll and/or harness exist which contain the unique features of our invention.

OBJECT OF THE INVENTION

An object of the present invention is to provide a doll's harness that is of simple construction and resembles the Child's Safety Harness.

Another object of the present invention is to provide a doll which contains a simple harness resembling the Child's Safety Harness.

The above objects are met with the present doll's harness and also with a doll wearing a harness as described herein.

DETAILED DESCRIPTION OF PREFERRED EMBODIMENTS

Figure 1:
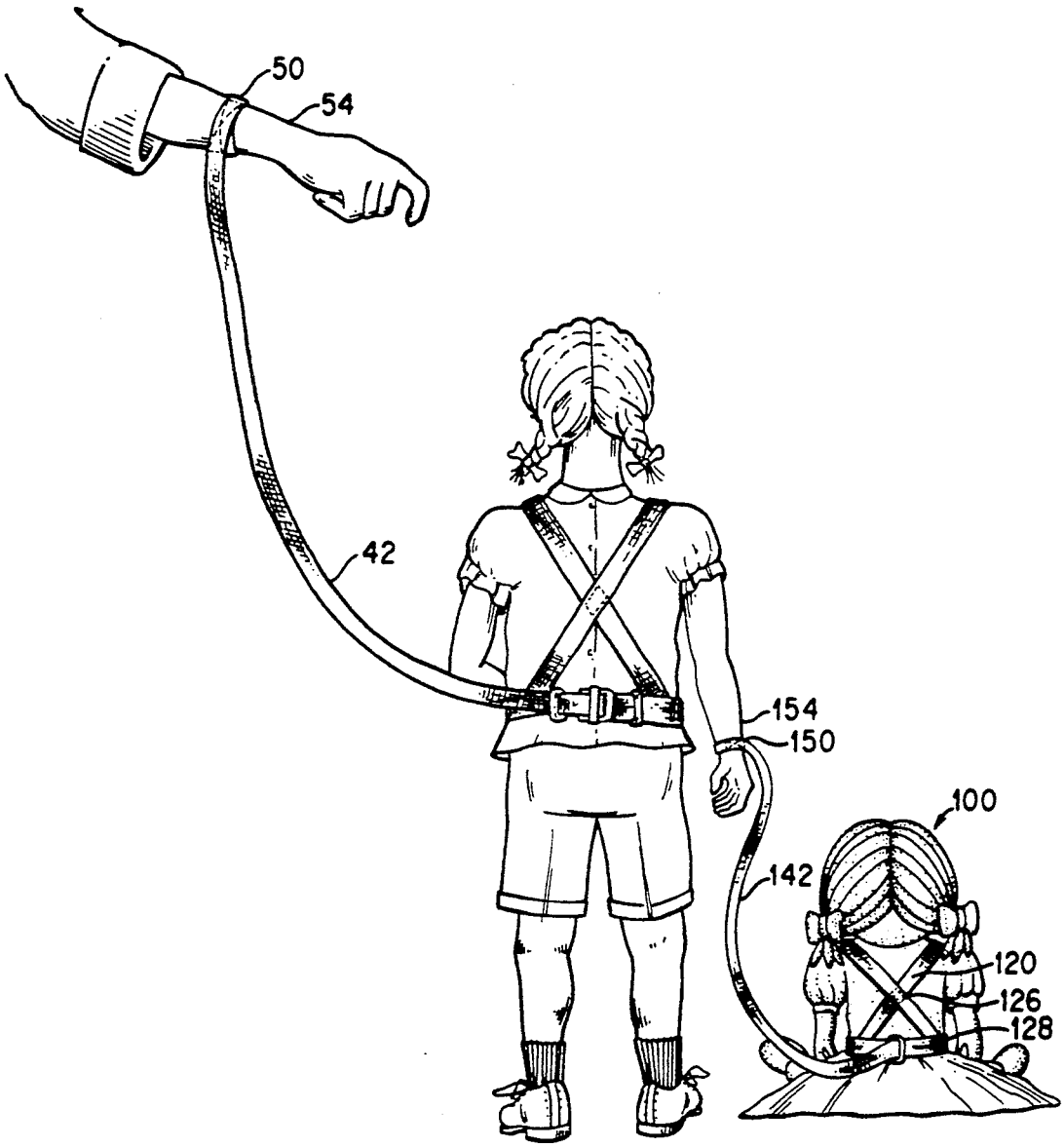
FIG. 1 is a back view of a doll wearing a harness in possession of a child wearing a Child's Safety Harness being contained by a guardian.
Figure 2:
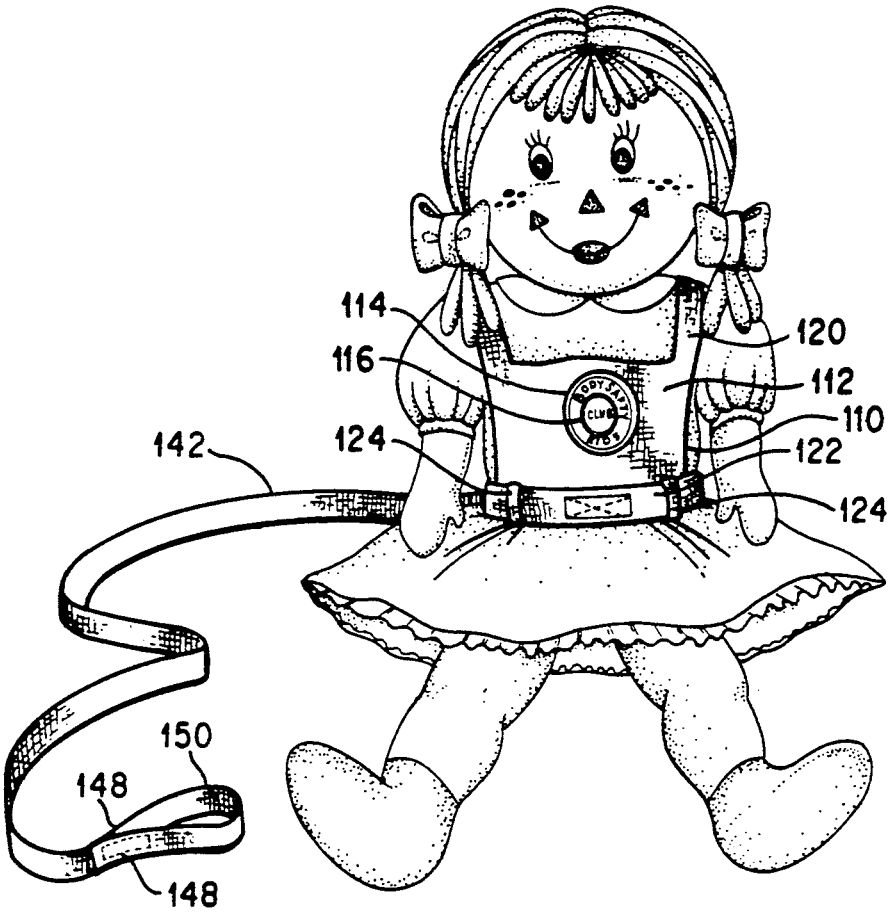
FIG. 2 is a front view of a doll wearing a harness.
Figure 3:
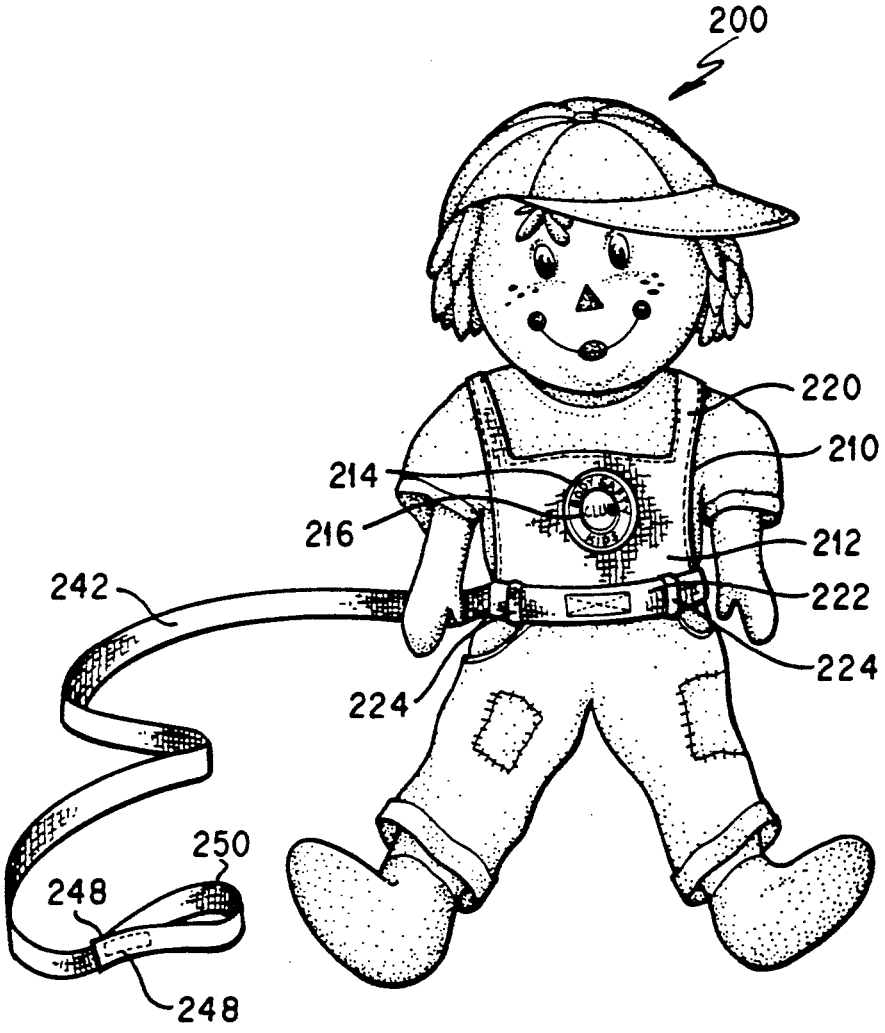
FIG. 3 is a front perspective view of a doll with a harness being an integral part of its structure.

The drawings illustrate a doll 100 in FIGS. 1, 2 and 5 and 200 in FIG. 3 in the form of a small human figure formed of cloth, plastic, or other material to simulate the shape and general appearance of a small child. Suitable material provide for the hair and features of the face so as to provide realistic appearance to the doll and to simulate various nationalities or races as desired. Suitable clothing is selected for dressing the doll so as to simulate either a young boy or girl. The doll can be provided in varying sizes, such as larger or smaller sizes to accommodate the different age groups or size categories of children.

Figure 4:
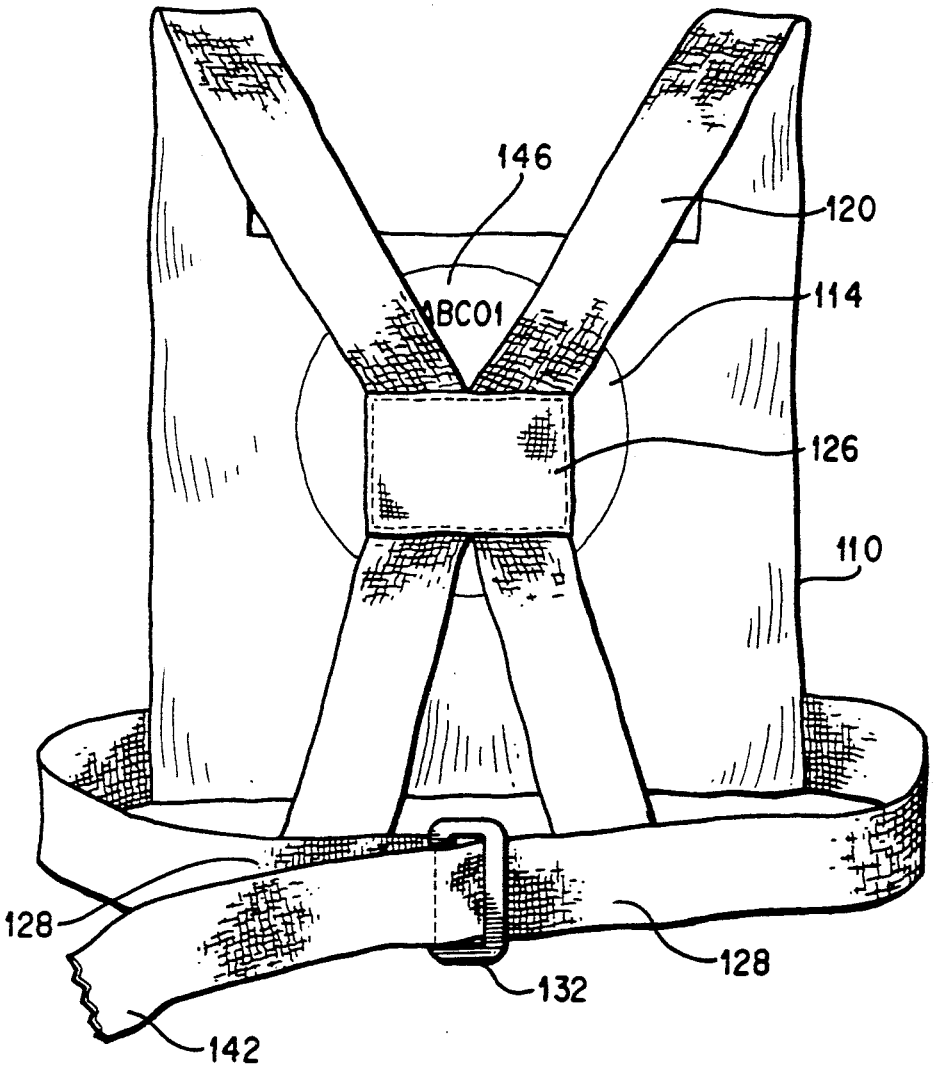
FIG. 4 is a back view of a doll's harness.
Figure 5:
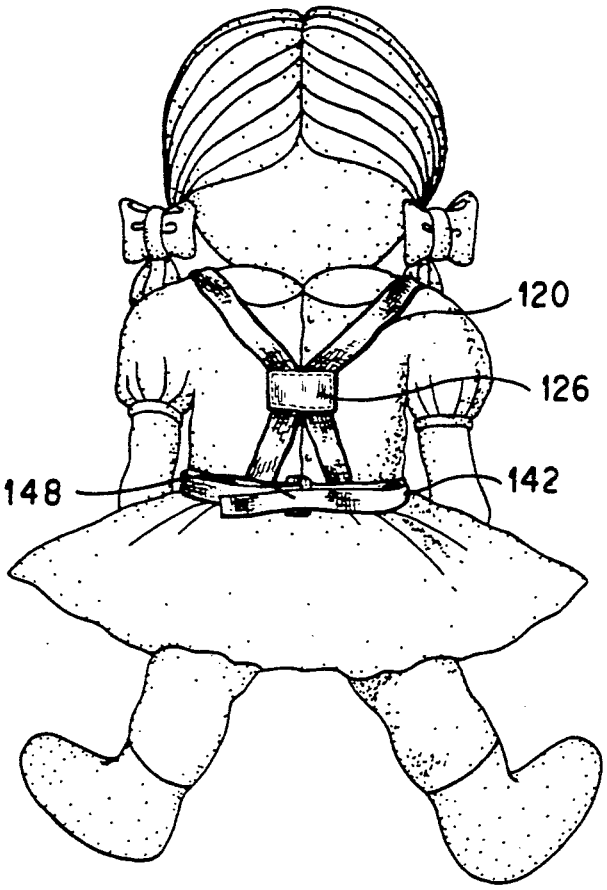
FIG. 5 is a back view of a doll wearing a harness.

On the doll in FIGS. 1, 2 and 5 is a harness 110 which is intended to resemble in appearance the Child's Safety Harness. The doll's harness can be a separate element of clothing as shown in FIGS. 1, 2, 4 and 5 which would allow the child to dress the doll with the harness as the child is dressed likewise with her harness. The harness 210 can also be an integral part of the doll's construction as seen in FIG. 3. In each structure, the harness can be prepared from light cloth plastic or similar material to resemble the Child's Safety Harness.

The doll's harness 110 can include any or all the elements of the Child's Safety Harness. Such elements as shown in FIG. 2 depict front vest 112 having the design of an emblem 114 thereon. The emblem can depict the logo "Body Safety Kids Club" 116 which conforms to the trademark of one of the inventors U.S. Trademark Reg. No. 1,538,277 which indicates the child's membership in a Safety Club. The front vest can have a pair of shoulder straps 120 attached at its top section and a waist belt 122 attached to its bottom section. Belt loops 124 can be attached to the waist belt to contain the waist belt.

As shown in FIG. 3, harness 210 is an integral unit of the doll's structure. It can include some or all of the elements of the Child's Safety Harness. Such elements can include front vest 212 with emblem 214 having logo 216 thereon, shoulder straps 220, waist belt 222 and belt loops 224. Tether belt 242 can be attached to the harness terminating into releasable loop 250 joined together by adhesive sections 248 which are discussed below with respect to FIG. 2.

FIGS. 1, 4 and 5 show a back view of doll harness 110 depicting connecting and/or criss-crossing 126 shoulder straps 120 with the lower ends 128 thereof attached to the waist belt. The waist belt extends around the back section of the harness where end elements can be sewed or joined together and can be looped through a belt buckle 132. At this point, the waist belt extends into tether belt 142 which terminates into releasable tether loop 150. The tether loop can be formed by joining together self-adhesive sections 148, such as VELCRO, attached to opposing sides of the tether belt at its free end as seen in FIG. 2. Code 146 is shown on the back of emblem 114 in FIG. 4.

FIG. 5 depicts tether belt 142 being contained on the harness being worn by the doll. This resembles the feature when the Child's Safety Harness is self-contained on the child. Tether belt 142 is circled around the doll and is secured in place by at least one adhesive section 148.

FIG. 1 illustrates the educational and recreation characteristics of the invention. As seen, a child is wearing a Child's Safety Harness and is in possession of doll 100 wearing a harness 110 in accordance with this invention. The child is under control of a guardian holding tether belt 42 shown extended with releasable tether loop 50 encircling the guardians wrist 54.

The doll's harness is seen to have many of the features of the Child's Safety Harness. The child is functioning as the guardian of the doll by being in control of the doll's tether belt 142 shown extended with releasable tether loop 150 encircling the child's wrist 154 in the same manner as a guardian of the child would be in control of the child's tether belt. Not only does it represent an enjoyable event for the child to be able to control the doll but also it helps to instill in the child the safety aspects of wearing the harness.

Many of the safety features of the Child's Safety Harness are also applicable to the present invention.

The instruction and coloring booklet contains pictorial and written description of how the safety and wearing elements of the doll's harness are similar to the Child's Safety Harness. By reviewing the pages and coloring the pictures, the child will be more aware of the safety features of the Child's Safety Harness.

Emblem 114 displays logo 116 which are similar to the emblem and logo for BODY SAFETY KIDS CLUB disclosed in the Child's Safety Harness. Hereto, the logo is to alert the public that the child is a member of the Safety Club. From code 146, the authorities will be able to contact the Club and to initiate identification.

The Registration Form, the Child's Membership Form Certificate and Newsletter, all applicable safety features of the Child's Safety Harness can likewise be applied to the present invention to enhance the safety of the child.

The doll's harness can be constructed of any quality of material which conforms to structure of the doll. It can be a uniformly structured garment following exactly the structure and material of the Child's Safety Harness or it can be a simple inexpensive cloth or plastic device. It can be an individual garment FIG. 2 to be put on the doll FIG. 1 or it can be an integral part of the doll's apparel FIG. 3. Preferably, it should contain a tether belt 142, an emblem 114 and an identification code.

While certain novel features of this invention have been shown and described, it will be understood that various changes in the forms and details of the doll's harness and doll wearing the harness and associated safety applications illustrated can be made by those skilled in the art without departing from the spirit of the invention.

What is claimed is:

1. A doll fitted with a harness, said harness comprising a unified vest harness having a front vest, a pair of connected back straps and a tether belt secured to the harness and having a free end, the front vest covering the upper front torso of the doll, the back straps fitted over the upper back torso of the doll and secured at the top to the front vest, the tether belt releasably attached at its free end to the harness, whereby said tether belt can be worn with its free end either attached to the harness or extended freely therefrom to be held by a person.

2. A doll according to claim 1 wherein the harness is prepared from a fabric material.

3. A doll according to claim 2 wherein the harness is provided with a waist belt and the back straps are secured at the lower ends to the waist belt encircling the lower back of the harness.

4. A doll according to claim 3 wherein the back straps criss-cross at the connecting point.

5. A doll according to claim 4 wherein the tether belt is an extension of the waist belt.

6. A doll according to claim 5 wherein an adjustable means is mounted on the waist belt at about the tether belt extension.

7. A doll according to claim 6 wherein the waist belt passes through belt loops attached to the harness.

8. A doll according to claim 7 wherein the free end of the tether belt is releasably self-contained on the harness by adhesive means.

9. A doll according to claim 8 wherein the free end of the tether belt is adapted to be held releasably self-contained on a person's wrist.

10. A doll according to claim 1 wherein an emblem containing a logo for identification is attached to the front vest.

11. A doll according to claim 10 wherein an identification code for a child is secured to the harness.

12. A doll according to claim 11 wherein the identification code is attached to the underside of the front vest.

13. A doll according to claim 1 wherein said harness is an integral unit of the doll structure.

* * * * *